US010654613B2

(12) United States Patent
Liu

(10) Patent No.: US 10,654,613 B2
(45) Date of Patent: May 19, 2020

(54) NESTING AND SHOCK ABSORBING PACKAGE

(71) Applicant: WESTERN DIGITAL TECHNOLOGIES, INC., Irvine, CA (US)

(72) Inventor: Sichang Liu, Irvine, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 10 days.

(21) Appl. No.: 15/639,988

(22) Filed: Jun. 30, 2017

(65) Prior Publication Data

US 2018/0215504 A1 Aug. 2, 2018

Related U.S. Application Data

(60) Provisional application No. 62/451,529, filed on Jan. 27, 2017.

(51) Int. Cl.

| | |
|---|---|
| ***B65D 6/00*** | (2006.01) |
| ***B65D 21/02*** | (2006.01) |
| ***B65D 81/02*** | (2006.01) |
| ***B65D 75/22*** | (2006.01) |

(52) U.S. Cl.

CPC ..... *B65D 11/20* (2013.01); *B65D 11/10* (2013.01); *B65D 21/0223* (2013.01); *B65D 75/22* (2013.01); *B65D 81/022* (2013.01)

(58) Field of Classification Search

CPC .... B65D 11/20; B65D 5/001; B65D 21/0209; B65D 21/0222; B65D 21/0223

USPC ..... 220/508

See application file for complete search history.

(56) References Cited

U.S. PATENT DOCUMENTS

| | | | |
|---|---|---|---|
| 2,585,180 | A | 2/1952 | Smith |
| D229,036 | S | 11/1973 | Joonase |
| D243,230 | S | 2/1977 | Kleiner |
| D244,352 | S | 5/1977 | Congleton |
| D250,172 | S | 11/1978 | Retelny |

(Continued)

FOREIGN PATENT DOCUMENTS

| | | | |
|---|---|---|---|
| CN | 1317436 | A | 10/2001 |
| CN | 2855930 | Y | 1/2007 |

(Continued)

OTHER PUBLICATIONS

Heybruck, Dr. William F. Drop Proofing a Hard Disk Drive. Hitachi Global Storage Technologies. www.hitachiGST.com. 2007.

(Continued)

*Primary Examiner* — Jeffrey R Allen

(74) *Attorney, Agent, or Firm* — Brinks Gilson & Lione

(57) ABSTRACT

A package for enclosing at least one item is disclosed. The package includes a first portion having a first surface including at least one protrusion, a second portion having a second surface including at least one indentation, and a hinge connecting the first portion to the second portion. The hinge is configured to allow the package to transition from an open position to a closed position. In the closed position the first portion and the second portion define an enclosed space for enclosing an item. The at least one protrusion and the at least one indentation may provide cushioning and shock absorption for the package and/or may allow the package to nest with another package stacked above or below the package.

21 Claims, 12 Drawing Sheets

(56) References Cited

U.S. PATENT DOCUMENTS

| | | | | |
|---|---|---|---|---|
| 4,241,830 | A | 12/1980 | Di Gesu' | |
| 4,440,303 | A | 4/1984 | Seager | |
| 4,593,816 | A * | 6/1986 | Langenbeck | B65D 25/06 206/425 |
| 5,335,770 | A | 8/1994 | Baker | |
| 5,899,331 | A | 5/1999 | Warren, Jr. | |
| 5,921,423 | A | 7/1999 | Howell | |
| 6,076,677 | A | 6/2000 | Pozzo | |
| 6,109,444 | A | 8/2000 | Bagwell | |
| D446,115 | S | 8/2001 | Merrell | |
| 6,321,911 | B1 * | 11/2001 | Raimer | B65D 21/0223 206/503 |
| 6,398,029 | B1 | 6/2002 | Farison et al. | |
| D470,053 | S | 2/2003 | Gratz | |
| 6,820,743 | B2 | 11/2004 | Hurley | |
| D520,882 | S | 5/2006 | Vovan | |
| D526,193 | S | 8/2006 | Heath | |
| 7,237,675 | B2 | 7/2007 | O'Malley | |
| D569,242 | S | 5/2008 | Flamand | |
| D587,106 | S | 2/2009 | Garrett | |
| 7,584,851 | B2 | 9/2009 | Hong et al. | |
| 7,660,107 | B2 | 2/2010 | Leung | |
| D629,310 | S | 12/2010 | Tran | |
| 8,083,084 | B2 | 12/2011 | Vovan | |
| 8,116,076 | B2 | 2/2012 | Cochrane | |
| 8,146,762 | B2 | 4/2012 | Leoncavallo | |
| D663,205 | S | 7/2012 | Nelson | |
| D663,206 | S | 7/2012 | Nelson | |
| 8,490,794 | B2 | 7/2013 | Kalin | |
| D743,250 | S | 11/2015 | Kikuhara | |
| D764,273 | S | 8/2016 | Klag | |
| D795,704 | S | 8/2017 | Tanus | |
| D796,954 | S | 9/2017 | Lun | |
| D799,341 | S | 10/2017 | Tanus | |
| D801,804 | S | 11/2017 | McCune | |
| D810,585 | S | 2/2018 | Kim | |
| 2001/0006153 | A1 | 7/2001 | Merrell | |
| 2003/0070959 | A1 | 4/2003 | Maresh | |
| 2003/0205498 | A1 | 11/2003 | Maresh | |
| 2005/0098467 | A1 * | 5/2005 | Agakanian | B65D 21/0204 206/471 |
| 2006/0274493 | A1 | 12/2006 | Richardson | |
| 2010/0126903 | A1 | 5/2010 | Smith | |
| 2011/0094918 | A1 * | 4/2011 | Hernandez | B65D 21/0223 206/521.15 |
| 2011/0096494 | A1 | 4/2011 | Cochrane | |
| 2011/0315566 | A1 * | 12/2011 | Boynton | A45C 11/16 206/6.1 |
| 2018/0215504 | A1 | 8/2018 | Liu | |
| 2018/0215529 | A1 | 8/2018 | Bergeron | |

FOREIGN PATENT DOCUMENTS

| | | | |
|---|---|---|---|
| CN | 201086931 | Y | 7/2008 |
| CN | 201597827 | U | 10/2010 |
| CN | 202163682 | U | 3/2012 |

OTHER PUBLICATIONS

ReFlex. ReFlex Cushions. Custom Solutions. Reflex Packaging Inc. 2016.

Office Action from Chinese Application No. 201711391746X dated Feb. 3, 2019.

Paper Pulp Protective Packaging, available Jun. 26, 2014, [online], [site visited Sep. 1, 2018]. Available from internet, <URL: https ://www.dreamstime.com/stock-photo-paper-pulp-protective-packaging-recycled-white-background-i mage42187734 (Year: 2014).

Eco Friendly Pulp Packaging for Western Digital, available Sep. 1, 2018, [online], [site visited Aug. 31, 2018]. Available from internet, <URL: https ://www .packaging .jjsea .com/Page Display.aspx?aid =24E2031 C-2C6E-44E0-B F7 A-67303 E9807 D2&action =ShowStoryDetail& id=719987c5-1911-4bf6-8ec1-f923c590582e (Year: 2018).

Pulp—the green packaging alternative, available May 31, 2013, [online], [site visited Sep. 1, 2018]. Available from internet, <URL: https://lessbydesign.org/2013/05/31 /pulp-the-green-packaging-alternative/ (Year: 2013).

Office Action of corresponding Chinese Patent Application No. 201711391746.X—10 pages (dated Oct. 21, 2019).

* cited by examiner

NESTING AND SHOCK ABSORBING PACKAGE

INCORPORATION BY REFERENCE TO ANY PRIORITY APPLICATIONS

This application claims priority to U.S. Provisional Patent Application No. 62/451,529, filed Jan. 27, 2017, which is incorporated herein by reference. Any and all applications for which a foreign or domestic priority claim is identified in the Application Data Sheet as filed with the present application are hereby incorporated by reference under 37 CFR § 1.57.

BACKGROUND

Field

This disclosure relates to packages for items. In particular, this disclosure describes nesting and/or shock absorbing packages for items.

Description

Packages are commonly used to enclose and protect items of all types during distribution, storage, sale, and/or use. Several examples of common types of packages include shipping cartons, boxes, blister packs, and clamshell containers, among many others, and may or may not include protective inserts. In many instances, packages are designed with a particular item in mind. Among other things, consideration may be given to the size, shape, weight, fragility, anticipated distribution environment, anticipated display and sale environment, and/or anticipated consumer of the item.

SUMMARY

In a first aspect, a package for enclosing at least one item is disclosed. The package comprises a first portion including a first surface having at least one protrusion; a second portion including a second surface having at least one indentation; and a hinge connecting the first portion to the second portion, the hinge configured to allow the package to transition between an open position and a closed position, wherein, in the closed position, the first portion and the second portion define a space for enclosing at least one item.

In some embodiments, the at least one protrusion comprises an arched ridge, and the at least one indentation comprises an arched ditch. In some embodiments, the at least one protrusion is positioned on the first surface and configured to nest with an indentation of another package stacked on a first side of the package. In some embodiments, the at least one indentation is positioned on the second surface and configured to nest with a protrusion of another package stacked on a second side the package. In some embodiments, the at least one protrusion is configured to space a first part of the first surface away from an item enclosed within the package to create sway space between the item and the first part of the first surface, and a second part of the first surface is configured to contact the item. In some embodiments, the at least one indentation is configured to space a first part of the second surface away from the item enclosed within the package to create sway space between the item and the first part of the second surface, and a second part of the second surface is configured to contact the item. In some embodiments, the first surface further includes a raised frame, and the second surface further comprises an indented frame. In some embodiments, the raised frame is configured to nest with an indented frame of another package stacked on a first side of the package, and the indented frame is configured to nest with a raised frame of another package stacked on a second side of the package. In some embodiments, the raised frame surrounds a depression, and the indented frame surrounds a boss. In some embodiments, the depression is configured to nest with a boss of another package stacked on the first side of the package, and the boss is configured to nest with a depression of another package stacked on the second side of the package.

In another aspect, a system of packages for items is described. The system comprises a first package having a first surface with a first topography; and a second package having a second surface with a second topography; wherein the second topography corresponds to and is configured to nest with the first topography, and the first package is configured to stack with the second package such that the first surface contacts the second surface.

In some embodiments, the first topography and the second topography are configured to inhibit the first surface from sliding relative the second surface. In some embodiments, the first package is configured to enclose a first item, a first portion of the first surface configured to contact the first item and a second portion of the first surface configured to be spaced away from the first item, and the second package is configured to enclose a second item, a first portion of the second surface configured to contact the second item and a second portion of the second surface configured to be spaced away from the second item. In some embodiments, the second portion of the first surface is configured to create a first sway space between the first item and the first surface, the second portion of the second surface is configured to create a second sway space between the second item and the second surface, and the first sway space and the second sway space are configured to overlap in a plane extending between the first item and the second item. In some embodiments, the second portion of the first surface comprises an arch shape, and the second portion of the second surface comprises an arch shape. In some embodiments, the first topography and the second topography each comprise a wavy structure.

In another aspect, a package for an item is disclosed. The package comprises a first wall comprising one or more protrusions configured to provide sway space between an item and the first wall, the one or more protrusions configured to minimize shock to the item from impact to the package; and a second wall comprising one or more indentations configured to at least partially contact the item; wherein one or more protrusions of a first package are configured to be positioned in one or more indentations of a second package such that corresponding external surfaces of the one or more protrusions of the first package contact corresponding external surfaces of the one or more indentations of the second package and the one or more protrusions nest within the one or more indentations.

In some embodiments, the one or more protrusions are convex, and the one or more indentations are concave. In some embodiments, the one or more protrusions and the one or more indentations have corresponding arch shapes. In some embodiments, the one or more protrusions comprise a first protrusion and a second protrusion, the first protrusion separated from the second protrusion by a valley of the first wall, and the one or more indentations comprise a first indentation and a second indentation, the first indentation separated from the second indentation by a raised portion of the second wall.

In some embodiments, the first wall or the second wall comprises a depression and the other of the first wall or the second wall comprises a boss, and a boss of the first package or the second package is configured to be positioned in a depression of the other of the first package or the second package such that corresponding external surfaces of the depression of the first package or the second package contacts corresponding external surfaces of the boss of the first package or the second package for the boss to nest within the indentations and inhibit movement of the first package relative to the second package along at least one direction.

In another aspect, a method of stacking at least two packages is disclosed. The method comprises providing a first package including a first surface comprising a first topography; providing a second package including a second surface comprising a second topography configured to nest with the first topography; and stacking the first package and the second package such that the first surface contacts and nests with the second surface. In some embodiments, stacking the first package and the second package comprises receiving a protrusion of the first topography within an indentation of the second topography. In some embodiments, the method further comprises enclosing a first item in the first package.

In another aspect, a package for an item is disclosed. The package comprises a first portion moveably connected to a second portion, the first portion and the second portion defining an enclosed space for receiving an item in a closed configuration, and a first means positioned on the first portion for nesting the first portion with another package. In some embodiments, the package includes a second means positioned on the first portion for cushioning an item within the package. In some embodiments, the first means comprises the second means.

BRIEF DESCRIPTION OF THE DRAWINGS

Various embodiments are depicted in the accompanying drawings for illustrative purposes, and should in no way be interpreted as limiting the scope of the inventions. The drawings may not be to scale.

DETAILED DESCRIPTION

Figure 1:
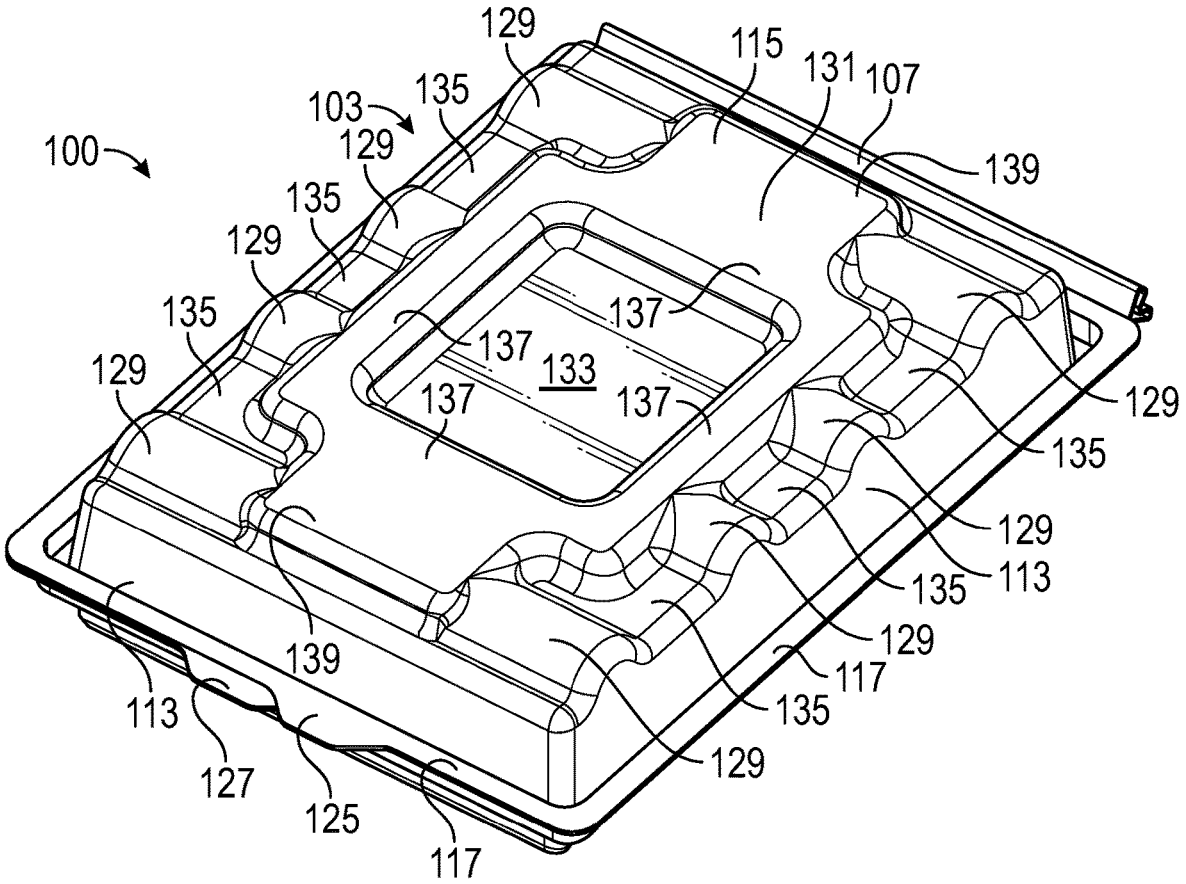
FIG. 1 is a top isometric view of an embodiment of a nesting and shock absorbing package.

This disclosure describes nesting and/or shock absorbing packages for items. In some embodiments, the packages include features that allow the packages to nest together when stacked. In some embodiments, this increases the stability of a stack of the packages and/or increases the volumetric efficiency of the packages. In some embodiments, stacked packages include overlapping sway space. In some embodiments, the packages include features that absorb shock and/or provide cushioning for items enclosed therein. In some embodiments, the shock absorbing features include one or more protrusions and/or indentations. In some embodiments, the protrusions and/or indentations comprise an arch shape. In some embodiments, the packages are used to enclose hard disk drives, such as 3.5 inch hard disk drives, although the packages described herein are not limited to only this application and can be used (or modified for use according to the principles described herein) with a wide range of items of different sizes, shapes, weights, etc. The packages described herein can enclose a single item or a plurality of items.

In the following detailed description, reference is made to the accompanying drawings. In the drawings, similar symbols typically identify similar components, unless context dictates otherwise. Thus, in some embodiments, part numbers can be used for similar components in multiple figures, or part numbers can vary from figure to figure. The illustrative embodiments described herein are not meant to be limiting. Other embodiments can be utilized, and other changes can be made, without departing from the spirit or scope of the subject matter presented. It will be readily understood that the aspects of the present disclosure and illustrated in the figures, can be arranged, substituted, combined, and designed in a wide variety of different configurations by a person of ordinary skill in the art, all of which are made part of this disclosure.

Reference throughout this disclosure to "one embodiment," "an embodiment," or "in some embodiments" means that a particular feature, structure, or characteristic described in connection with the embodiment is included in at least one embodiment. Moreover, the appearance of these or similar phrases throughout the specification does not necessarily all refer to the same embodiment, nor are separate or alternative embodiments necessarily mutually exclusive. Various features are described herein which can be exhibited by some embodiments and not by others.

Figure 2:
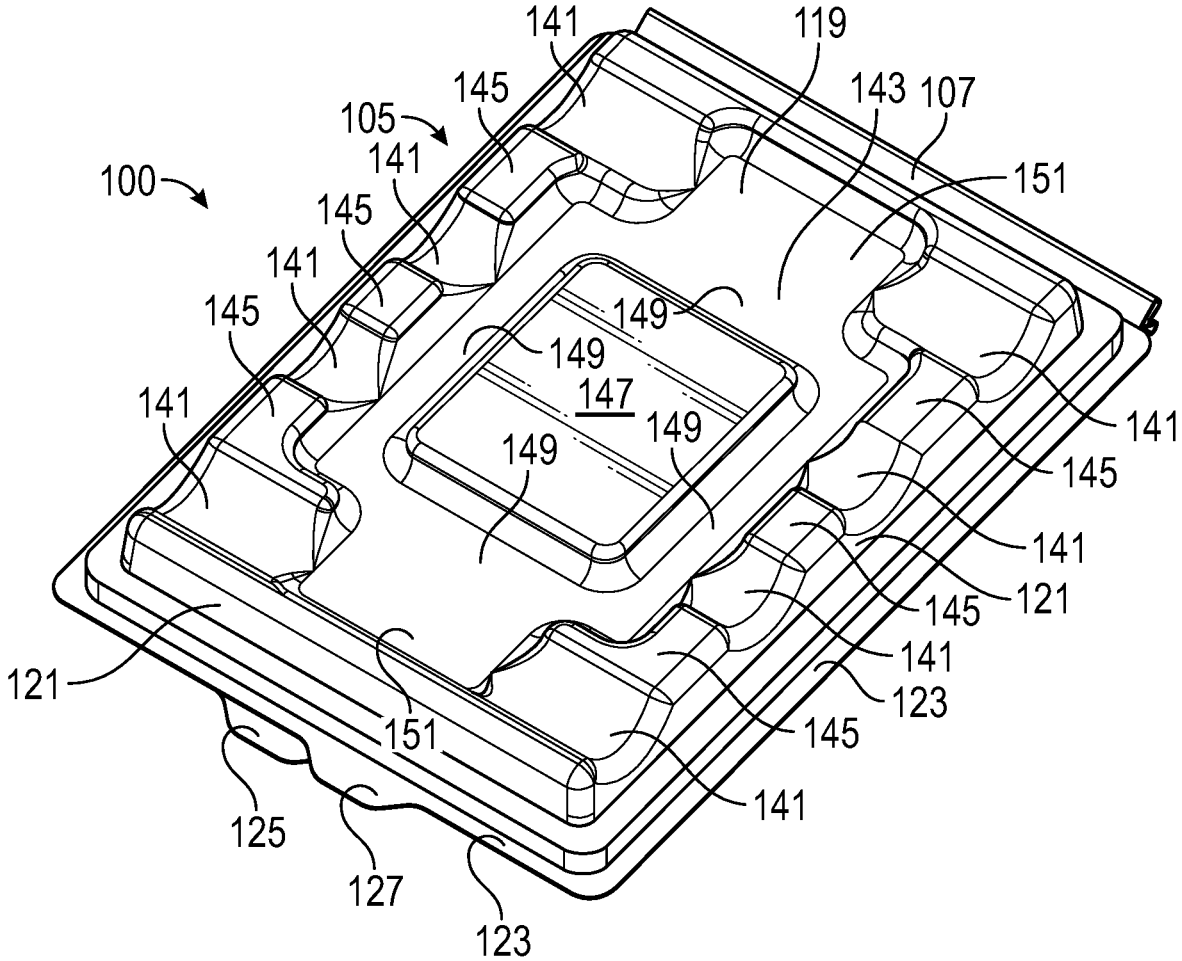
FIG. 2 is a bottom isometric view of the package of FIG. 1.

FIGS. 1 and 2 are top and bottom isometric views of an embodiment of a nesting and shock absorbing package (packaging, carton, container, etc.) 100. In the figures, the package 100 is illustrated in a closed configuration (i.e., in a configuration in which an item could be enclosed therein). As illustrated, for some embodiments, the package 100 includes a first (e.g., top) portion 103 and a second (e.g., bottom) portion 105. As illustrated, for some embodiments, the top portion 103 is connected to the bottom portion 105 by a hinge 107. As illustrated, for some embodiments, the package 100 is a one-piece container or package (such as a one-piece container consisting of two halves joined by a hinge, which allows the structure to come together to close). In some embodiments, the package 100 is a clamshell package. In some embodiments, the hinge 107 is a living hinge that is integrally formed with the top portion 103 and the bottom portion 105. In some embodiments, the hinge 107 can be formed by connecting the top portion 103 and the bottom portion 105 by any suitable or known process or processes, including permanent adhesive, thermal bonds, ultrasonic bonds, spot welds, i.e., thermal weld points, a stitch or stitches, strip welds, tacks formed by crimping, and so forth, including any combination thereof.

In some embodiments, the hinge 107 is omitted, such that the top portion 103 is not attached or permanently joined to the bottom portion 105. In some embodiments, the top portion 103 is a lid portion and the bottom portion 105 is a base portion. In some embodiments, the top portion 103 and the bottom portion 105 each comprise one or more walls, which can include or form any of the features discussed herein for the top portion 103 (e.g., top surface 115, sidewalls 113, protrusions 129, raised frame 131, etc.) and for the bottom portion 105 (e.g., bottom surface 119, sidewalls 121, raised portions 145, boss 147, etc.).

Figure 3:
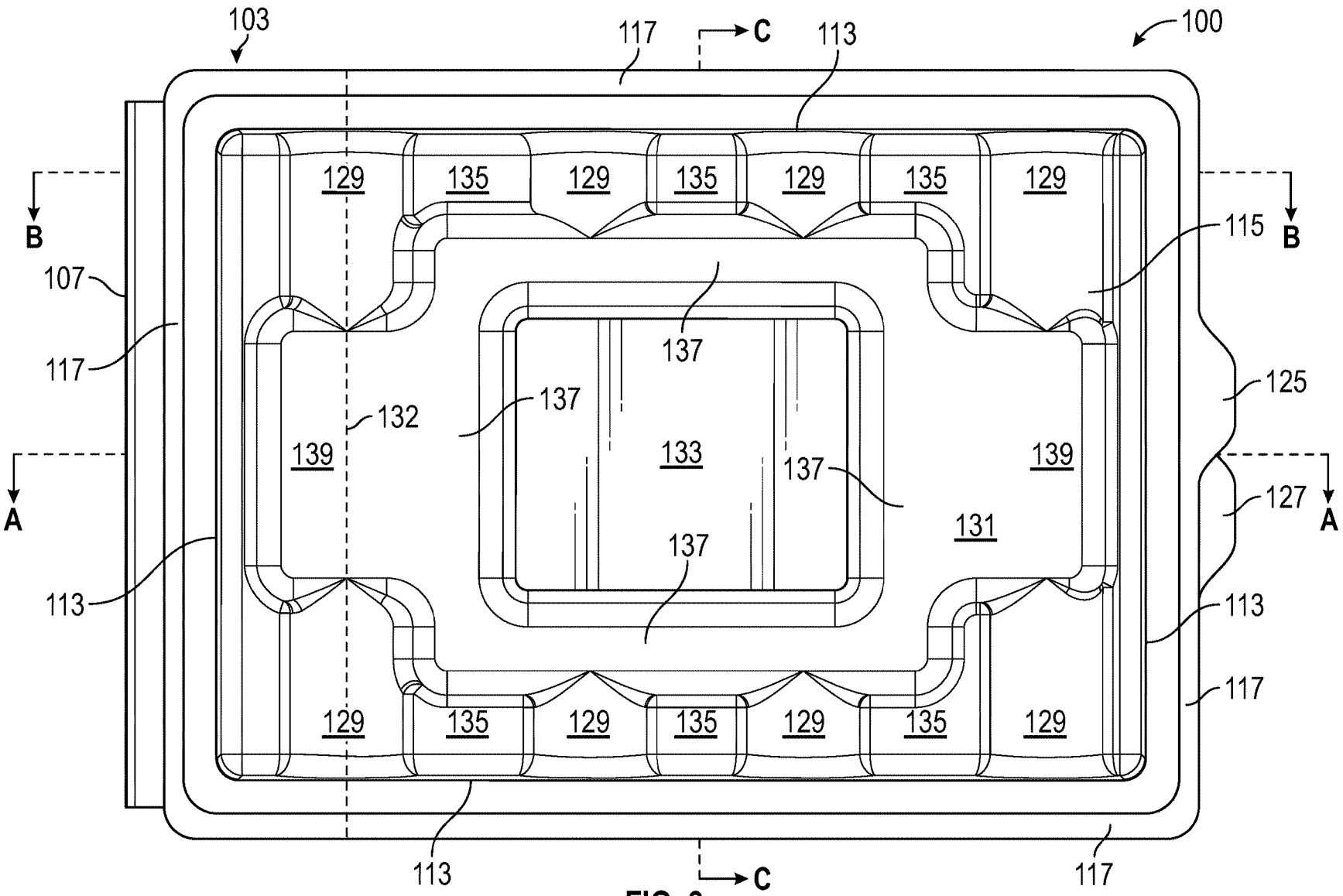
FIG. 3 is a top view of the package of FIG. 1.

As shown in the top perspective view of FIG. 1 and the top view of FIG. 3, in some embodiments, the top portion 103 includes a top surface 115, sidewalls 113, and a flange 117. As will be described below, the top surface 115 can be configured in size and shape to provide nesting and/or shock absorbing features for the package 100. As illustrated, for some embodiments, when viewed from above, the top surface 115 of the package 100 is generally rectangular (although other shapes are possible depending on, for example, the shape of the item to be enclosed in the package 100). As illustrated, for some embodiments, four sidewalls 113 extend downwardly from the edges of the top surface 115 to the flange 117. In some embodiments, the sidewalls 113 are generally perpendicular to the top surface 115 and/or the flange 117. In some embodiments, the sidewalls 113 connect to the top surface 115 and/or the flange 117 at an angle that is greater than 90 degrees (e.g., 95 degrees, 100 degrees, 105 degrees, 110 degrees, 115 degrees, 120 degrees, 125 degrees, 130 degrees, 135 degrees, or larger or smaller angles). In some embodiments, the top portion 103 is generally concave down.

Figure 4:
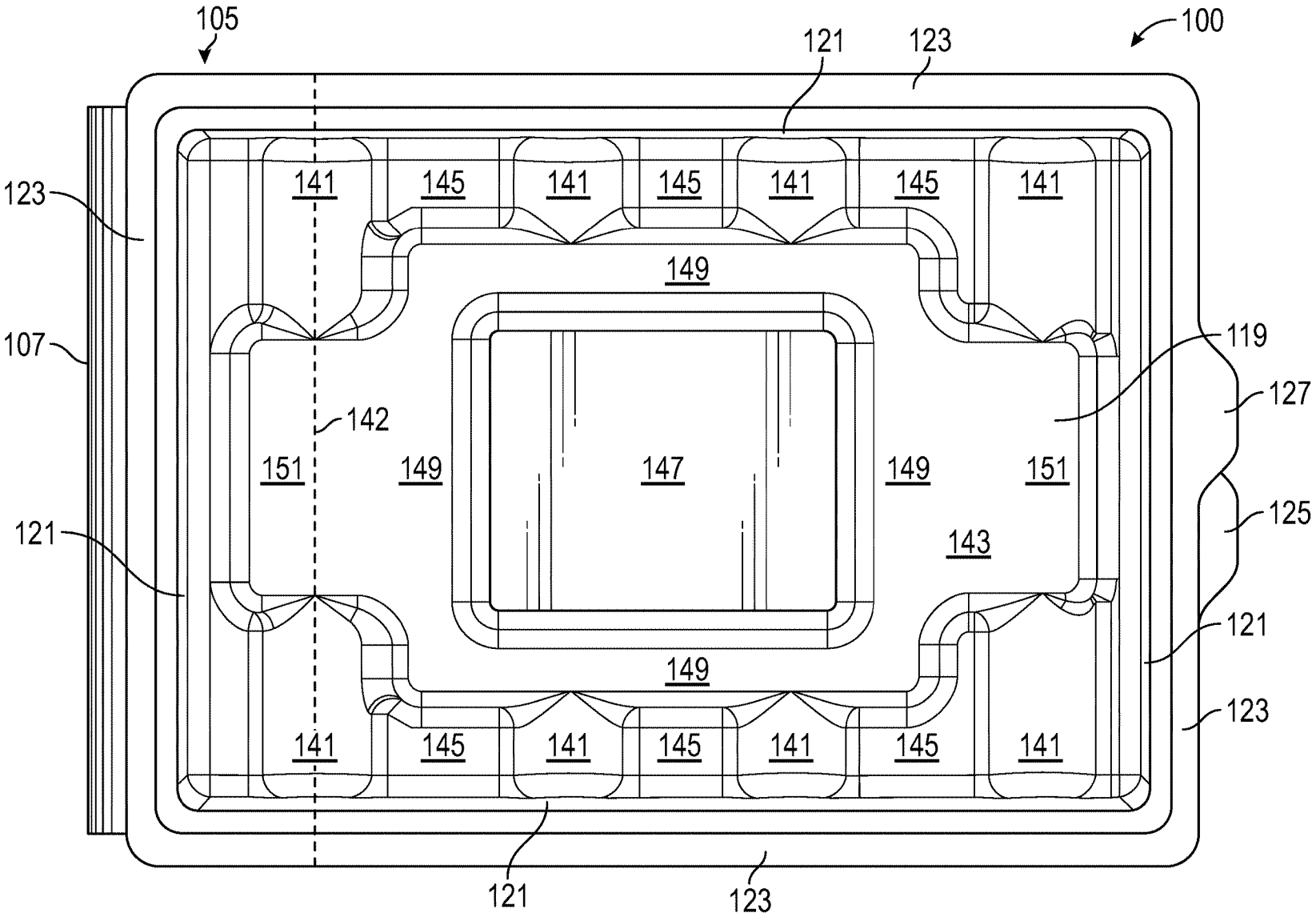
FIG. 4 is a bottom view of the package of FIG. 1.
Figure 5:
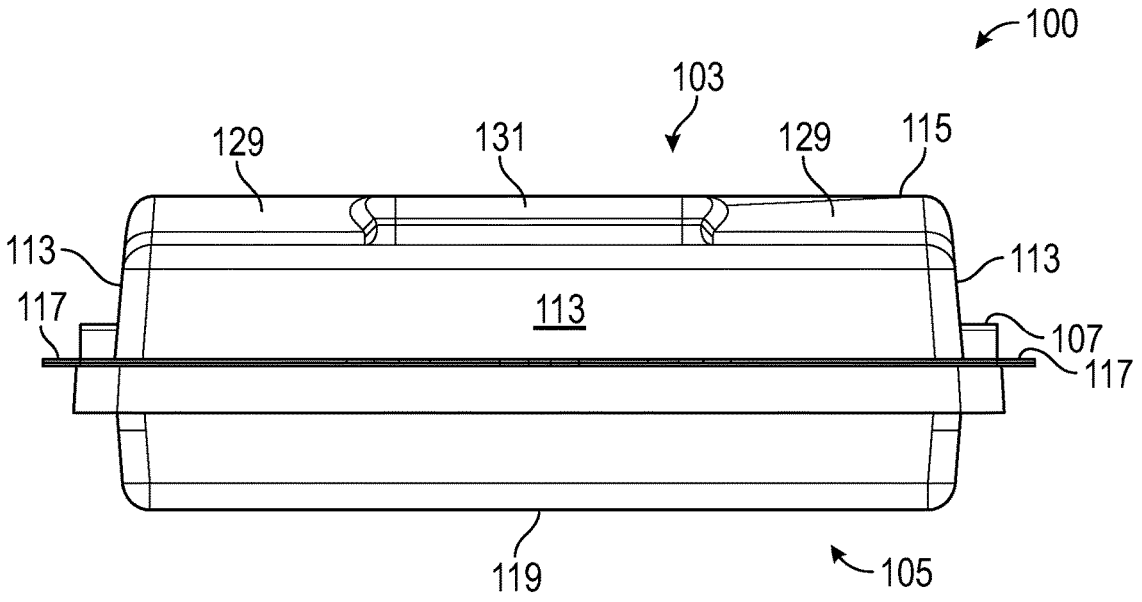
FIG. 5 is a front end view of the package of FIG. 1.
Figure 6:
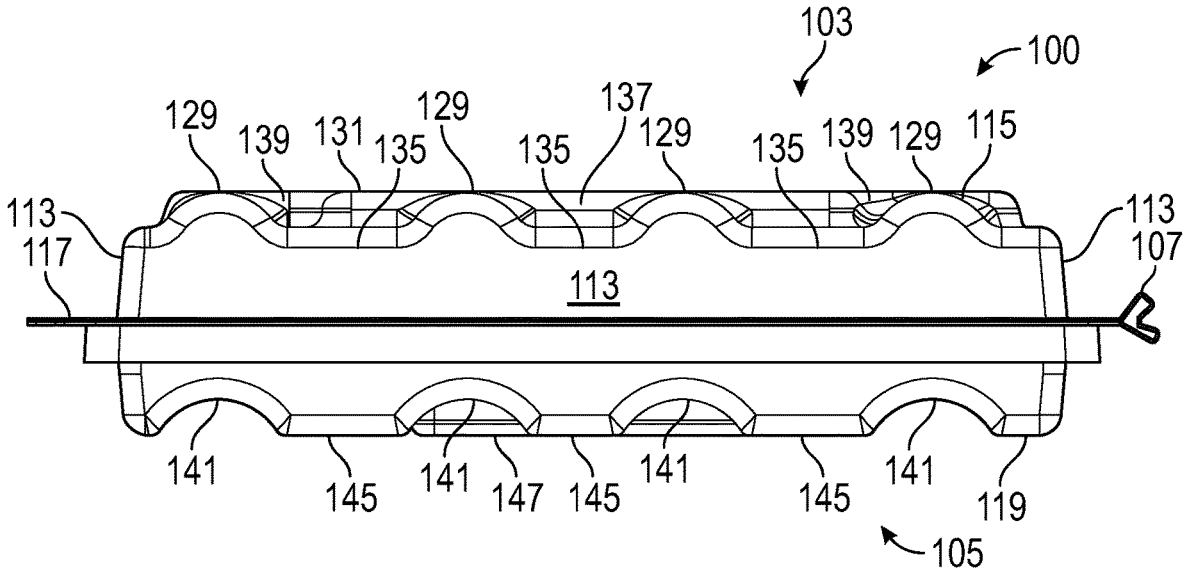
FIG. 6 is a side view of the package of FIG. 1.

As shown in the bottom perspective view of FIG. 2 and the bottom view of FIG. 4, in some embodiments, the bottom portion 105 includes a bottom surface 119, sidewalls 121, and a flange 123. As will be described below, the bottom surface 119 can be configured in size and shape to provide nesting and/or shock absorbing features for the package 100. As illustrated, for some embodiments, when viewed from below, the bottom surface 119 of the package 100 is generally rectangular (although other shapes are possible). In some embodiments, the general size and shape of the bottom surface 119 is similar to the general size and shape of the top surface 115 of the top portion 103. As illustrated, for some embodiments, four sidewalls 121 extend upwardly from the edges of the bottom surface 119 to the flange 123. In some embodiments, the sidewalls 121 are generally perpendicular to the bottom surface 119 and/or the flange 123. In some embodiments, the sidewalls 121 connect to the bottom surface 119 and/or the flange 123 at an angle that is greater than 90 degrees (e.g., 95 degrees, 100 degrees, 105 degrees, 110 degrees, 115 degrees, 120 degrees, 125 degrees, 130 degrees, 135 degrees, or larger or smaller angles). In some embodiments, the bottom portion 105 is generally concave up.

In the closed configuration (as illustrated), the flange 117 of the top portion 103 can contact the flange 123 of the bottom portion 105. This can join (e.g., releasably or permanently close) the top portion 103 to the bottom portion 105. In some embodiments, the flange 117 can be attached to the flange 123, for example, by welding, thermal bonding (e.g., heat sealed), adhesive, or mechanical fasteners, or other methods to secure the package 100 in the closed configuration. In some embodiments, the flange 117 and the flange 123 can have corresponding shapes such that the flange 117 engages (e.g., through friction) with the flange 123 to releasably close the package. In some embodiments, the flange 117 and the flange 123 can be releasably closed with any suitable mechanism that can hold the top portion 103 and the bottom portion 105 together in a desired closed position, such as, for example, interference fit mechanisms, snap fit mechanisms, and the like, which can include using male and female mating parts (e.g., tongue-and-groove corresponding parts). As illustrated, for some embodiments, the flange 117 includes a tab 125 and the flange 123 includes a tab 127 that may aid a user in closing or opening the package 100.

Figure 9:
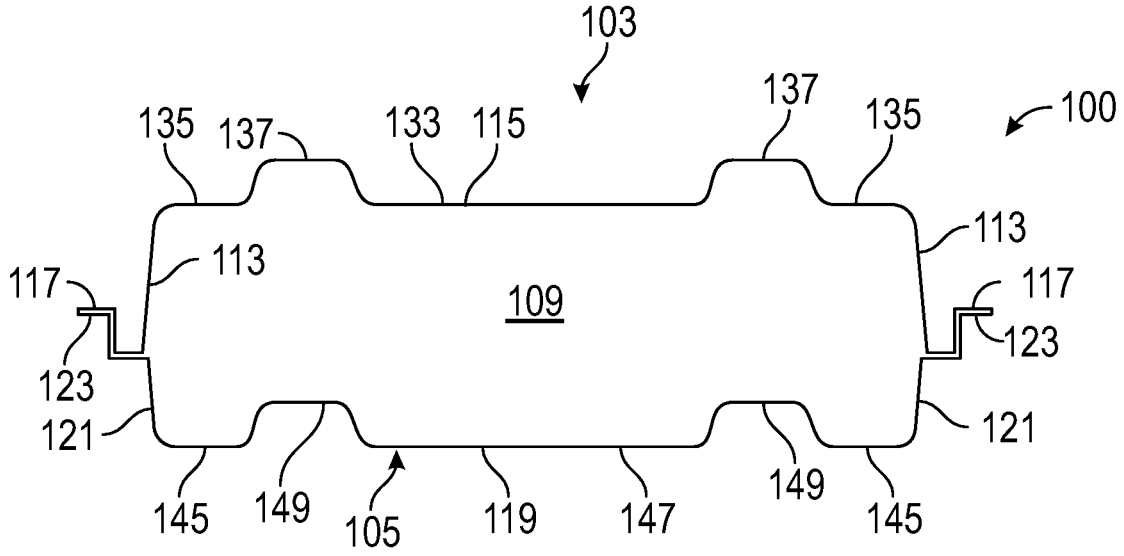
FIG. 9 is a cross-sectional view of the package of FIG. 1, taken along the line C-C shown in FIG. 3.
Figure 10:
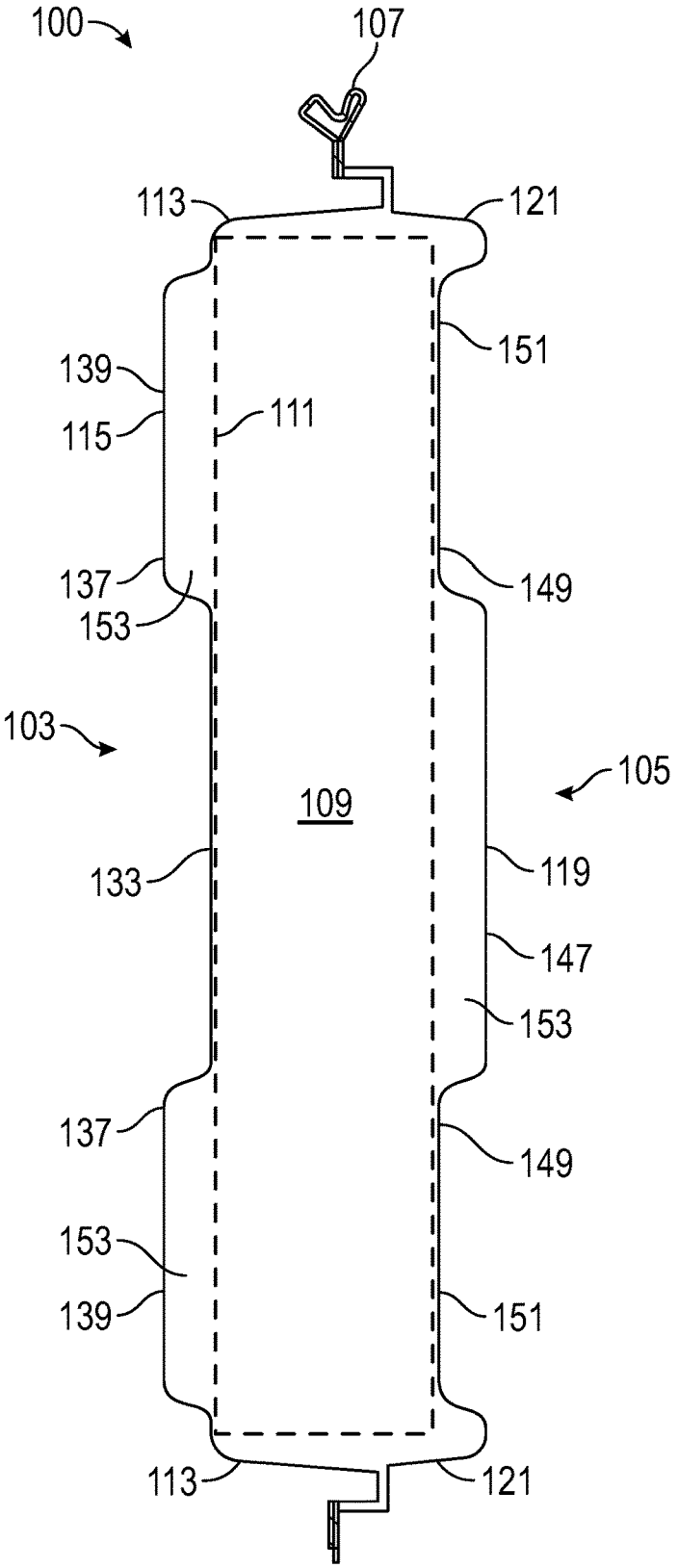
FIG. 10 is a cross-sectional view of the package of FIG. 1, taken along the line A-A shown in FIG. 3, and illustrates an example placement of an item within the package.
Figure 11:
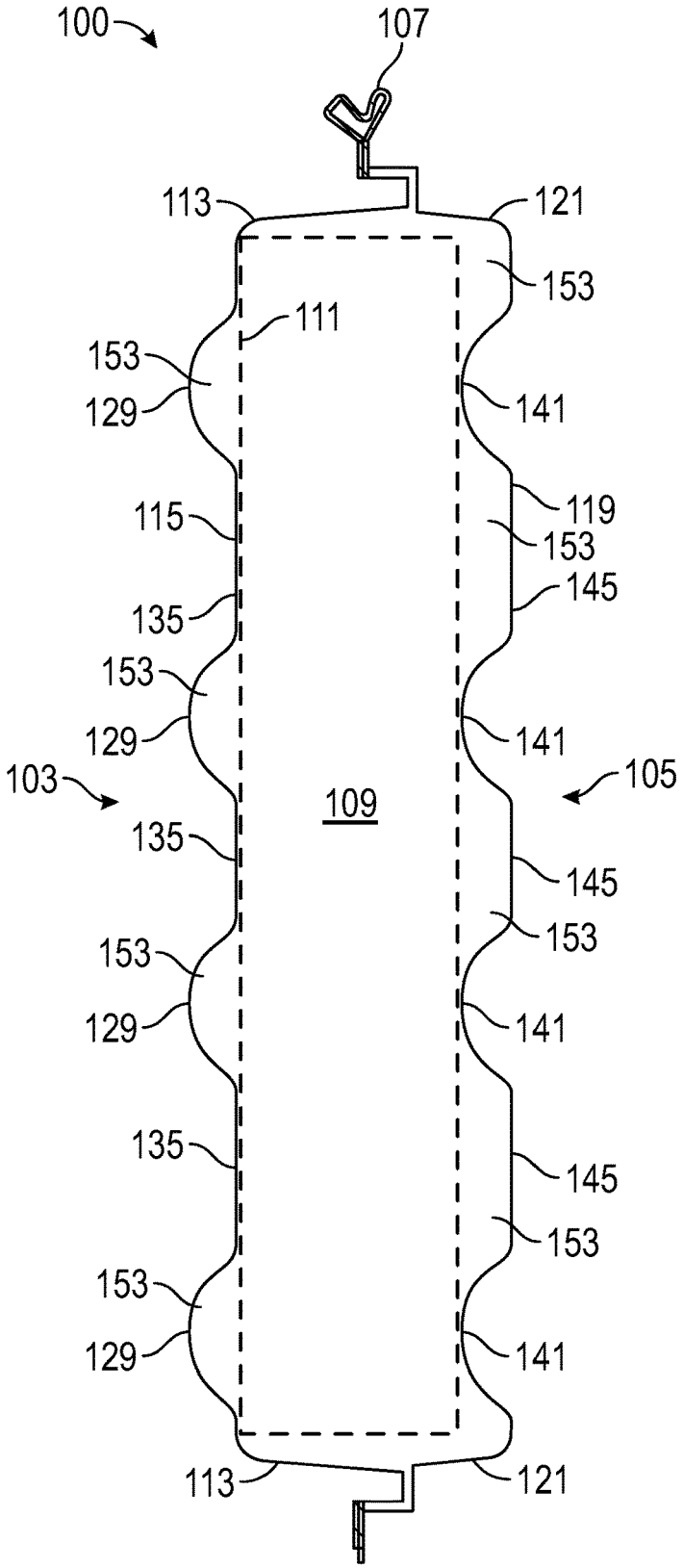
FIG. 11 is a cross-sectional view of the package of FIG. 1, taken along the line B-B shown in FIG. 3, and illustrates an example placement of an item within the package.
Figure 12:
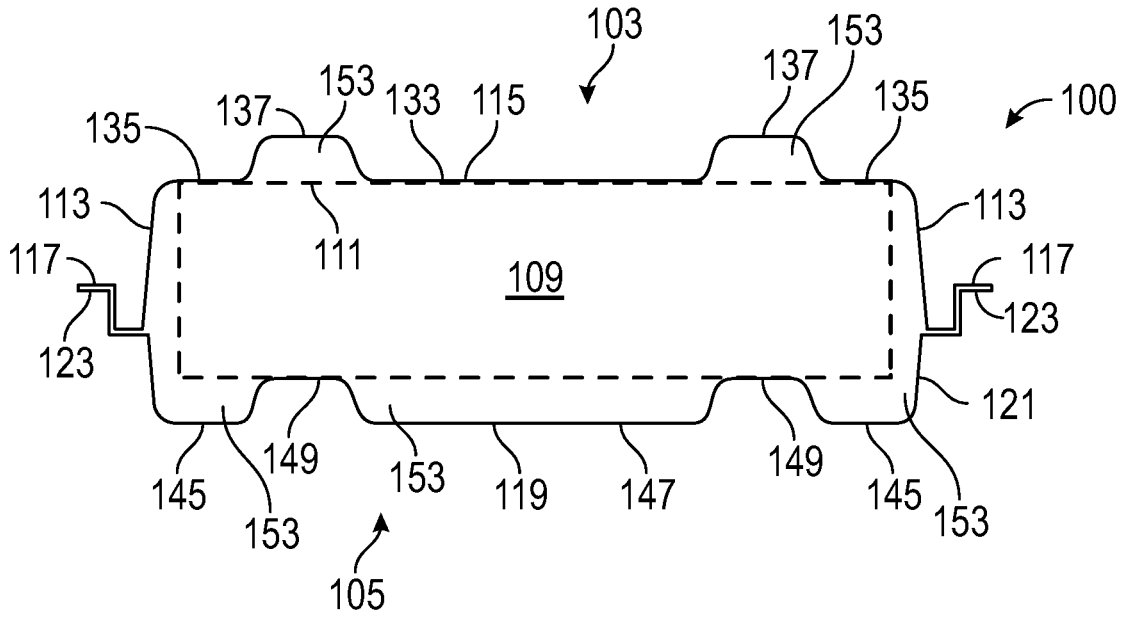
FIG. 12 is a cross-sectional view of the package of FIG. 1, taken along the line C-C shown in FIG. 3, and illustrates an example placement of an item within the package.

In the closed configuration (as illustrated), the top portion 103 and the bottom portion 105 define an enclosed space 109 (see, for example, the cross-sectional views of FIGS. 7-12) which can enclose an item 111 (as shown in FIGS. 10-12). As illustrated, for some embodiments, the package 100 is configured for enclosing a 3.5 inch hard disk drive ("HDD"), which is generally rectangular in shape having approximate dimensions of 5.75 inches by 4 inches by 1 inch. An approximate position of the item 111 (e.g., the illustrated HDD) within the package 100 is shown in the cross-sectional views of FIGS. 10-12, which are described below. Although the illustrated embodiment of the package 100 is capable of being used with a HDD, this disclosure is not intended to be limited thereto. That is, the package 100 can be used or modified for use with a wide variety of items 111 of different types, shapes, sizes, etc. In some embodiments, the package 100 is capable of supporting the item 111 within the package 100 directly (i.e., without the use of an insert or separate support structure). In some embodiments, the package 100 encloses an insert or other support structure which supports the item 111 within the package 100.

In some embodiments, the package 100 (including the top portion 103, the bottom portion 105, and/or the hinge 107) is manufactured from a sheet of thin (e.g., less than 5 mm, less than 2.5 mm, less than 1.5 mm, less than 1.0 mm, less than 0.75 mm, less than 0.5 mm, less than 0.25 mm, less than 0.15 mm, less than 0.1, or thinner) material. For example, in some embodiments, the package 100 is thermoformed from a thin plastic film or sheet. Suitable materials for thermoforming include high-density polyethylene (HDPE), polyvinyl chloride (PVC), polyvinylidene chloride (PVDC), polychlorotrifluoro ethylene (PCTFE), polyethylene terephthalate (PET), cyclic olefin copolymers (COC) or cyclic olefin polymers (COP), or other thermoplastic polymers. As another example, in some embodiments, the package 100 is manufactured from molded pulp or molded fiber. Other materials and manufacturing processes (for example, cold forming, compression molding, injection molding, and/or thermoforming techniques) are also possible. In some embodiments, the package 100 can be mass produced in high volumes.

In some embodiments, the sheet of the thin material of the package 100 can be shaped to form the features of the top portion 103 (e.g., top surface 115, side walls 113, protrusions 129, raised frame 131, etc.), the bottom portion 105 (e.g., bottom surface 119, side walls 121, raised portions 145, boss 147, etc.), and/or the hinge 107.

Figure 13:
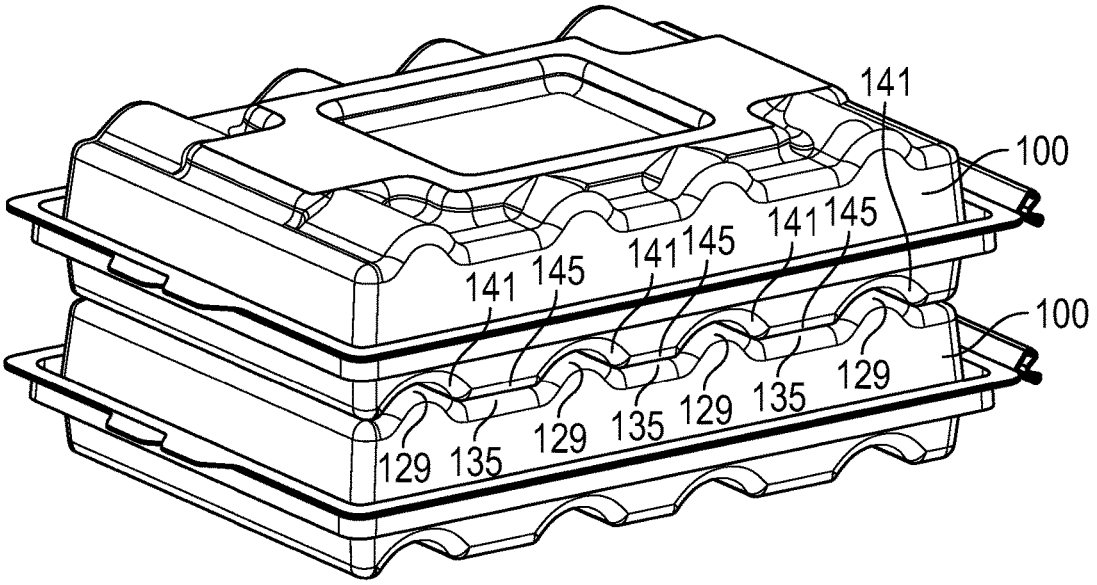
FIG. 13 is an isometric view of an embodiment of two nesting and shock absorbing packages in a nested or stacked configuration.
Figure 14:
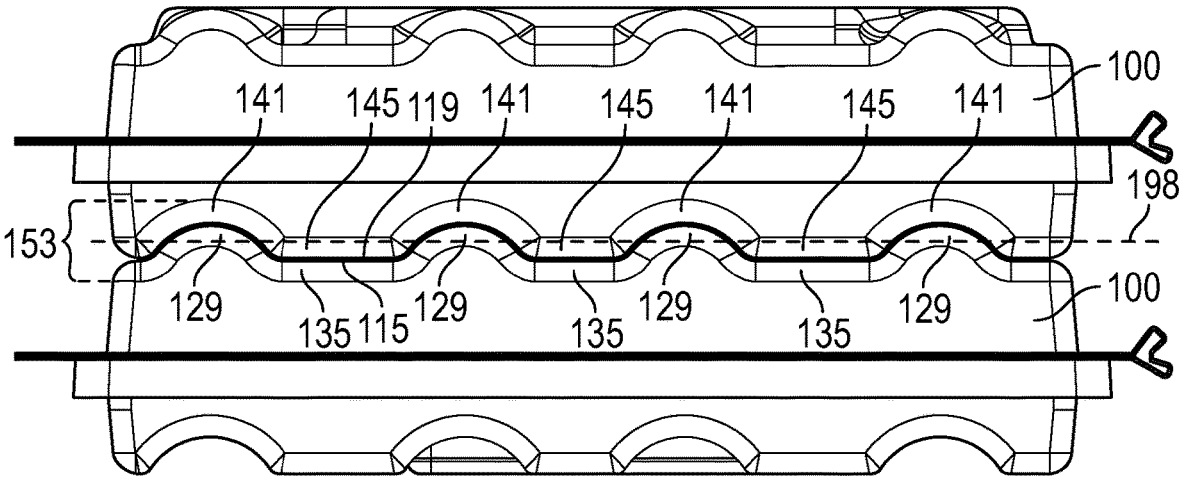
FIG. 14 is a side view of the two packages of FIG. 13 in the nested or stacked configuration.

As noted previously, in some embodiments, the top portion 103 and the bottom portion 105 of the package 100 are configured in size and shape such that the package 100 provides nesting and/or shock absorbing features or functionality. For example, the top surface 115 of the top portion 103 of a first package 100 can include a topography (i.e., a shape) that nests with a topography of the bottom surface 119 of the bottom portion 105 of a second package 100 when the second package 100 is placed on top of the first package 100 (for example, as shown in FIGS. 13 and 14, described below). Further, in some embodiments, the topography of the top surface 115 and/or the bottom surface 119 may include features that extend above and/or below the item 111 to be secured in the package 100 to provide cushioning, shock absorption, and/or sway space for the item 111 (see, for example, the cross-sectional views of FIGS. 10-12). In some embodiments, the external surfaces of the topography of one package 100 (for example, an external surface of a protrusion 129) contacts an external surface of the topography of another package 100 (for example, an indentation 141) when staked.

With reference to FIGS. 1, 3, 5 and 6, the top portion 103 of the illustrated embodiment of the package 100 includes the top surface 115. The top surface 115 includes protrusions 129. The protrusions 129 can comprise many shapes. The protrusions 129 may be convex. The protrusions 129 can comprise arched (e.g., rounded) ridges or ribs (as illustrated) triangular ridges or ribs, rectangular ridges or ribs, pentagonal ridges or ribs, other polygonal ridges or ribs, spherical protuberances or bumps, ellipsoid protuberances or bumps, cylindrical protuberances or bumps, pyramidal protuberances or bumps, square protuberances or bumps, other polygonal protuberances or bumps, or other shapes. In some embodiments, the protrusions 129 comprise fins. As noted above, for some embodiments, the convex protrusions 129 comprise arched ridges. The arched ridges can have a substantially constant radius, although this need not be the case in all embodiments.

As illustrated, for some embodiments, the protrusions 129 extend along (or parallel to) an axis across the shorter dimension of the top surface 115 (e.g., axis 132 illustrated in FIG. 3). In some embodiments, the protrusions 129 can extend along (or parallel to) an axis across the longer dimension of the top surface 115 (e.g., an axis perpendicular to the axis 132). In some embodiments, the protrusions 129 can extend along the top surface 115 along a curved axis or at an angle with respect to the long or short dimensions of the top surface 115.

As illustrated, for some embodiments, four ribs or protrusions 129 extend inwardly from each of the longer sidewalls 113 of the top portion 103. In some embodiments, other numbers of protrusions 129 can be included, such as, one, two, three, four, five, six, seven, eight, nine, ten, or more. In some embodiments, the protrusions 129 are separated by troughs, ditches, indentations, or valleys 135. In some embodiments, the valleys 135 are substantially flat (as illustrated), although this need not always be the case. In some embodiments, the protrusions 129 and the valleys 135 alternate to form a sinusoidal and/or wavy structure (e.g., an arch-shaped span with domain intervals to facilitate absorbing outside impact or shock more efficiently). As will be described below, the protrusions 129 and/or the valleys 135 can provide nesting and/or shock absorbing features for the package 100.

As illustrated, for some embodiments, the top surface 115 of the top portion 103 includes a frame 131. The frame 131 can surround a recess or depression 133. As illustrated, for some embodiments, the depression 133 is a square or rectangular depression, although other shapes (e.g., circular, triangular, pentagonal, other polygonal, or other) are possible. In some embodiments, more than one depression 133 is formed in the frame 131. In some embodiments, the depression 133 is configured to be approximately as deep as the valleys 135. As illustrated, for some embodiments, the depression 133 is substantially centered on the top surface 115 and the frame 131, although other placements for the depression 133 are possible. In some embodiments, the depression 133 is omitted.

The frame 131 can be formed by walls 137. The walls 137 may be raised relative to the valleys 135 and/or depression 133. As illustrated, for some embodiments, four walls 137 form a raised square or rectangle around the square or rectangular depression 133. In some embodiments, the height of the walls 137 is substantially the same as the height of the protrusions 129 and/or the depth of the depression 133 or valleys 135. As illustrated, for some embodiments, the frame 131 includes wings 139 that extend from front and back walls 137 to the front and back sidewalls 113 (i.e., the shorter sidewalls 113) of the top portion 103. In some embodiments, the frame 131, additionally or alternatively, includes wings 139 that extend to the longer sidewalls 113. In some embodiments, the height of the wings 139 is substantially the same as the height of the walls 137. In some embodiments, the wings 139 are omitted. In some embodiments, the frame 131 is omitted.

As illustrated, for some embodiments, the outermost two protrusions 129 on each side of the package 100 extend from the longer sidewalls 113 to the wings 139, and the innermost two protrusions 129 on each side of the package 100 extend from the longer sidewalls 113 to the walls 137 of the frame 131. The illustrated arrangement provides merely one example of many possible topographies for the top surface 115. Other arrangements are possible. For example, the package 100 may not include the wings 139, and the outermost two protrusions 129 on each side of the package 100 may extend into each other to form a continuous protrusion 129 on or along two corresponding sides of the package 100. In some embodiments, one or more inner protrusions 129 may extend into each other to form a continuous protrusion across the package 100.

In some embodiments, the bottom portion 105 includes a bottom surface 119 that corresponds to the top surface 115 of the top portion 103. That is, a topography of the bottom surface 119 can correspond to a topography of the top surface 115 such that the bottom surface 119 of one package 100 nests with a top surface 115 of another package 100 when the packages 100 are stacked (for example, as shown in FIGS. 13-14). For example, as shown in FIGS. 2, 4, 5 and 6, the bottom portion 105 of the illustrated embodiment of the package 100 includes a bottom surface 119 that includes depressions, grooves, ditches, or indentations, 141.

The indentations 141 can comprise many shapes. In some embodiments, the indentations 141 are concave. For example, the indentations 141 can comprise arched (e.g., rounded) ditches or troughs, triangular ditches or troughs, rectangular ditches or troughs, pentagonal ditches or troughs, other polygonal ditches or troughs, spherical dimples or concavities, ellipsoid dimples or concavities, cylindrical dimples or concavities, pyramidal dimples or concavities, square dimples or concavities, other polygonal dimples or concavities, or other shapes. The shape of the indentations 141 is configured to correspond to the shape of the protrusions 129 such that the protrusions 129 can be received within and nest with the indentations 141.

As illustrated, for some embodiments, the indentations 141 comprise arched ditches. The arched ditches can have a substantially constant radius, although this need not be the case in all embodiments. The radius of the arched ditches can correspond to the radius of the arched ridges of the protrusions 129. As illustrated, for some embodiments, the indentations 141 extend along (or parallel to) an axis across the shorter dimension of the bottom surface 119 (e.g., axis 142 illustrated in FIG. 4). In some embodiments, the indentations 141 can extend along (or parallel to) an axis across the longer dimension of the bottom surface 119 (e.g., an axis perpendicular to the axis 142). In some embodiments, the indentations 141 can extend along the bottom surface 119 along a curved axis or at an angle with respect to the long or short dimensions of the bottom surface 119.

As illustrated, for some embodiments, four indentations 141 extend inwardly from each of the longer sidewalls 121 of the bottom portion 105. In some embodiments, other numbers of indentations 141 can be included, such as, one, two, three, four, five, six, seven, eight, nine, ten, or more. The indentations 141 may be separated by raised portions 145. The shape of the raised portions 145 can be configured to correspond to the shape of the valleys 135 such that the raised portions 145 can be received within and nest with the valleys 135. In some embodiments, the tops of the raised portions 145 are substantially flat, although this need not always be the case. In some embodiments, the indentations 141 and the raised portions 145 alternate to form a sinusoidal and/or wavy structure (e.g., an arch-shaped span with domain intervals to facilitate absorbing outside impact or shock more efficiently). The wavy structure of the bottom surface 119 is configured to correspond to and nest with the sinusoidal and/or wavy structure of the top surface 115. As will be described below, the indentations 141 and/or the raised portions 145 can provide nesting and/or shock absorbing features for the package 100.

As illustrated, for some embodiments, the bottom surface 119 of the bottom portion 105 also includes an frame 143. The frame 143 may be indented. The frame 143 can surround a protrusion or boss 147. The boss 147 may be raised relative to the frame 143. As illustrated, for some embodiments, the boss 147 is square or rectangular, although other shapes (e.g., circular, triangular, pentagonal, other polygonal, or other) are possible. In some embodiments, more than one boss 147 is formed in the frame 143. In some embodiments, the boss 147 is configured to be as tall as the raised portions 145. As illustrated, for some embodiments, the boss 147 is substantially centered on the bottom surface 119, although other placements for the boss 147 are possible. In some embodiments, the boss 147 is omitted. The boss 147 may be configured in size and shape to correspond to the depression 133, such that the boss 147 of a first package 100 can be received within and nest with the depression 133 of a second package 100 when stacked (see FIGS. 13 and 14). The arrangement of the depression 133 and the boss 147 as described and illustrated can facilitate stacking of the packages 100, in for example, a vertical direction.

The frame 143 can be formed by indented portions 149. As illustrated, for some embodiments, four indented portions 149 form a depressed square or rectangle around the square or rectangular boss 147. In some embodiments, the depth of the indented portions 149 is substantially the same as the depth of the indentations 141. As illustrated, for some embodiments, the frame 143 also includes indented wings 151 that extend from front and back indented portions 149 to the front and back sidewalls 121 (i.e., the shorter sidewalls 121) of the bottom portion 105. In some embodiments, the frame 143, additionally or alternatively, includes indented wings 151 that extend to the longer sidewalls 121. In some embodiments, the depth of the indented wings 151 is substantially the same as the depth of the indented portions 149. In some embodiments, the indented wings 151 are omitted. In some embodiments, the frame 143 is omitted. The frame 143 is configured in size and shape to correspond to the frame 131, such that the indented frame 143 of a first package 100 can receive and nest with the frame 131 of a second package 100 when stacked. The arrangement of the frame 131 and the indented frame 143 as described and illustrated can facilitate stacking of the packages 100, in, for example, a vertical direction.

As illustrated, for some embodiments, the outermost two indentations 141 on each side of the package 100 extend from the longer sidewalls 121 to the indented wings 151, and the innermost two indentations 141 on each side of the package 100 extend from the longer sidewalls 121 to one of the indented portions 149 of the frame 143. The illustrated arrangement provides merely one example of many possible topographies for the bottom surface 119. Other arrangements are possible. For example, the package 100 may not include the indented wings 151, and the outermost two indentations 141 on each side of the package 100 may extend into each other to form a continuous indentation 141 on or along two corresponding sides of the package 100. In some embodiments, one or more inner indentations 141 may extend into each other to form a continuous indentation 141 extending generally across the package 100.

Figure 7:
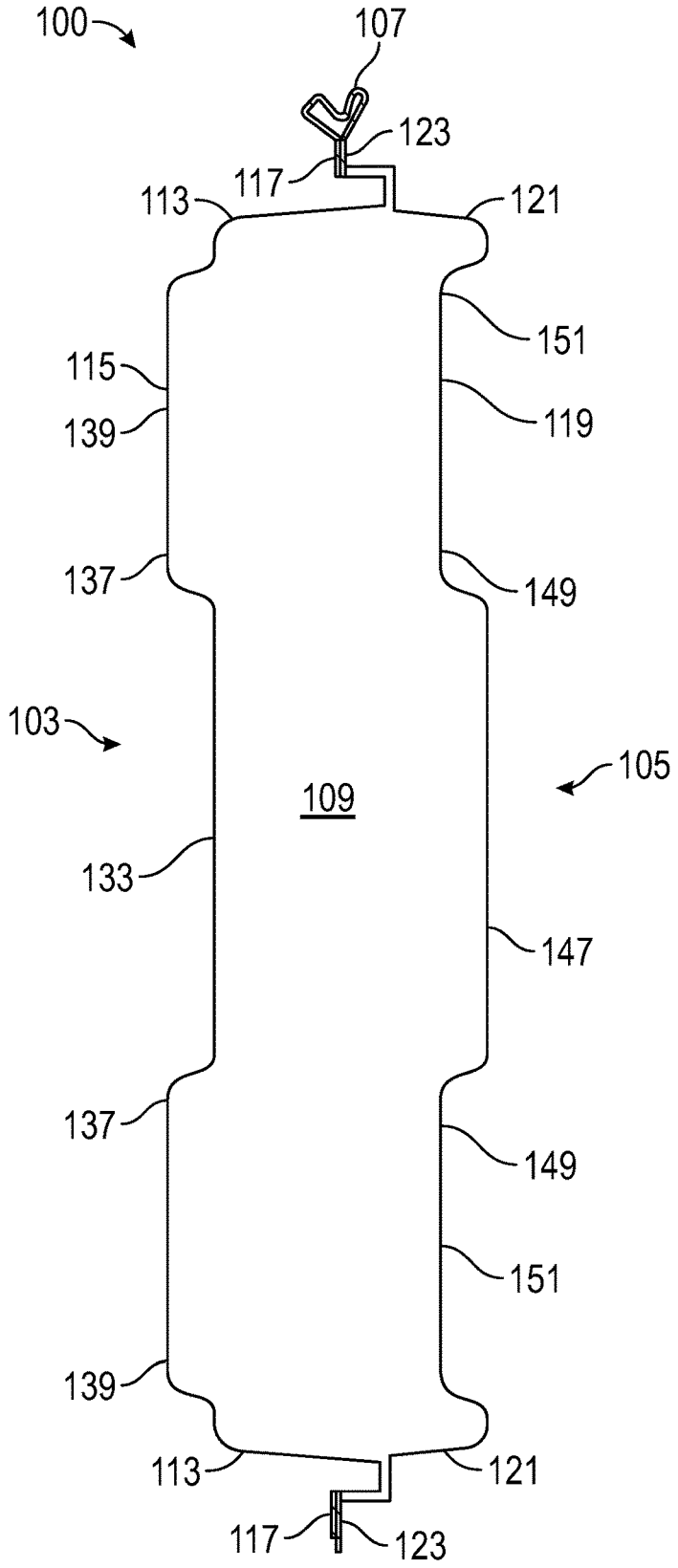
FIG. 7 is a cross-sectional view of the package of FIG. 1, taken along the line A-A shown in FIG. 3.
Figure 8:
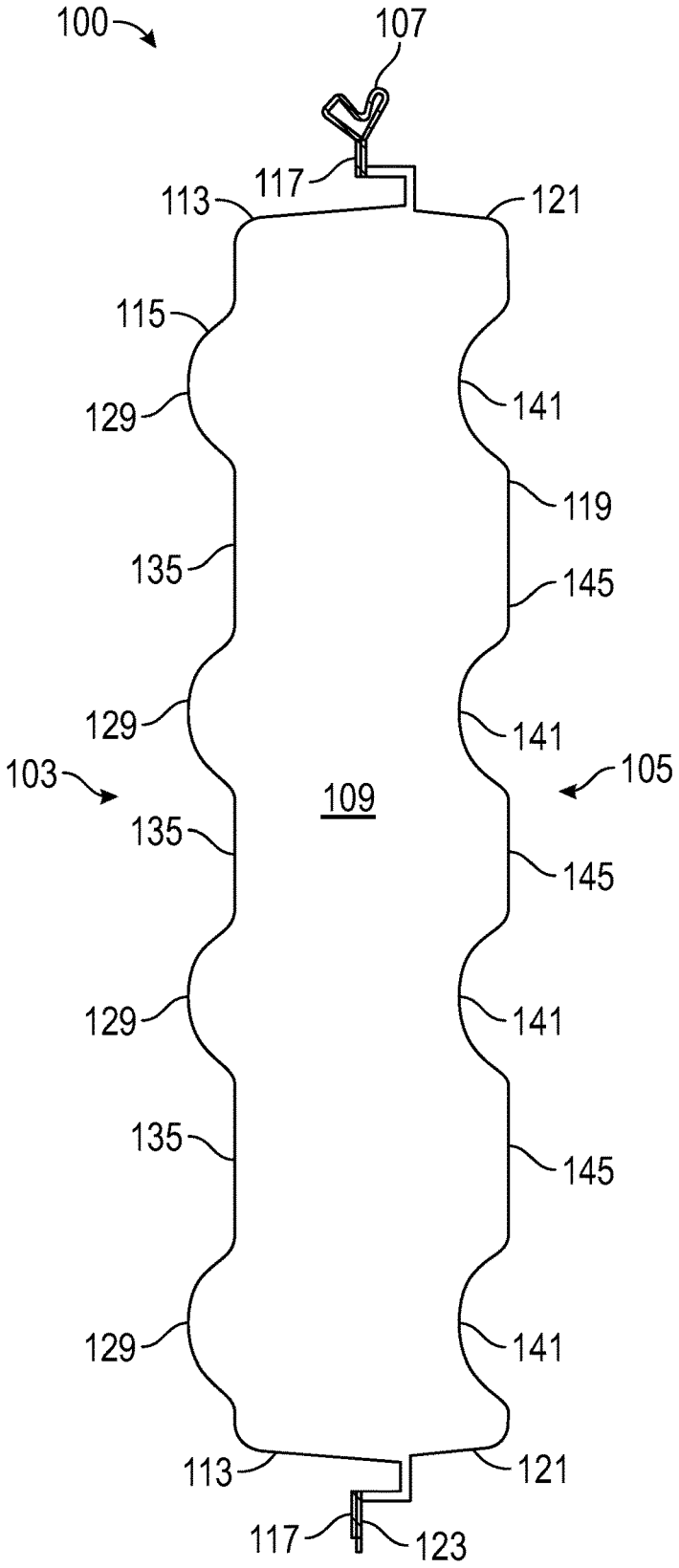
FIG. 8 is a cross-sectional view of the package of FIG. 1, taken along the line B-B shown in FIG. 3.

FIGS. 7-9 are cross-sectional views of the package 100 taken along the lines shown in FIG. 3. For clarity, only the cut-through portions of the package 100 are shown, with all other lines being omitted. Thus, FIGS. 7-9 are useful in illustrating the profiles of the topographies of the top and bottom surfaces 115, 119 at the location where the cross-section is taken.

FIG. 7 is a cross-sectional view of the package 100 taken along the line A-A shown in FIG. 3. As shown, the topography of the top surface 115 of the top portion 103 corresponds to or mimics the topography of the bottom surface 119 of the bottom portion 105. For example, the top surface 115 includes raised portions (formed by the walls 137 and the wings 139) and an indented portion (formed by the depression 133). And, the bottom surface 119 includes indented portions (formed by the indented wings 151 and the indented portions 149) and a raised portion (formed by the boss 147). The shape of the raised and indented portions of the top surface 115 corresponds with the shape of the raised and indented portions of the bottom surface 119.

FIG. 8 is a cross-sectional view of the package 100 taken along the line B-B shown in FIG. 3. As shown, again the topography of the top surface 115 of the top portion 103 corresponds to the topography of the bottom surface 119 of the bottom portion 105. For example, the top surface 115 includes raised portions (formed by the protrusions 129) and indented portions (formed by the valleys 135). And, the bottom surface 119 includes indented portions (formed by the indentations 141) and raised portions (formed by the raised portions 145). The shape of the raised and indented portions of the top surface 115 corresponds with the shape of the raised and indented portions of the bottom surface 119.

FIG. 9 is a cross-sectional view of the package 100 taken along the line C-C shown in FIG. 3. Again, the topography of the top surface 115 of the top portion 103 corresponds to the topography of the bottom surface 119 of the bottom portion 105. For example, the top surface 115 includes raised portions (formed by the walls 137) and indented portions (formed by the valleys 135 and the depression 133). And, the bottom surface 119 includes indented portions (formed by the indented portions 149) and raised portions (formed by the raised portions 145 and the boss 147). The shape of the raised and indented portions of the top surface 115 corresponds with the shape of the raised and indented portions of the bottom surface 119.

Considering FIGS. 7-9, when one package 100 is placed on top of another (see FIGS. 13-14), the raised portions of the top surface 115 of the bottom package 100 are received within the indented portions of the bottom surface 119 of the top package 100. Similarly, the indented portions of the top surface 115 of the bottom package 100 received the raised portions of the bottom surface 119 of the top package 100.

Although cross-sections at specific locations are shown in FIGS. 7-9 and discussed above, in some embodiments, the topography of the top surface 115 corresponds to the topography of the bottom surface 119 at substantially all corresponding points. Thus, the complimentary and corresponding top and bottom surfaces 115, 119 are configured to allow the packages 100 to nest together when stacked (e.g., the protrusions 129, the indentations 141, the depression 133, the boss 147, the valleys 135, the raised portions 145, the walls 137, the indented portions 149, the wings 139, and/or the indented wings 151 correspondingly nest). Additionally, in some embodiments, the corresponding topographies of the top and bottom surfaces 115, 119 ensure, maintain, or increase the likelihood that the two packages 100 maintain a particular orientation when stacked. For example, the illustrated topographies only permit two packages 100 to be stacked when aligned and centered (e.g., the protrusions 129, the indentations 141, the depression 133, the boss 147, the valleys 135, the raised portions 145, the raised walls 137, the indented portions 149, the raised wings 139, and/or the indented wings 151 correspondingly nest at a certain orientation).

Further, the corresponding topographies may help prevent one package 100 from sliding off another. In some embodiments, the corresponding topographies inhibit or prevent one package 100 from sliding off another in only a single direction. In some embodiments, the corresponding topographies inhibit or prevent one package 100 from sliding off another in multiple directions (e.g., the depression 133, the boss 147, the walls 137, indented portions 149, wings 139, and/or indented wings 151 may inhibit sliding in a direction substantially along top and bottom surfaces 115, 119 to serve as a locking feature between packages 100). Accordingly, the interlocking pattern of the corresponding topographies of the packages 100 provide nesting, alignment, and/or anti-slip features or functionality. The interlocking patterns of the packages 100 can facilitate nesting of the packages 100, providing one or more advantages, including, but not limited to: allowing the packages to be securely stacked; increasing the volumetric efficiency by, for example, decreasing the amount of space required to store the packages; and decreasing the amount of sway space in the packages 100.

FIGS. 10-12 are additional cross-sectional views of the package 100 taken along the lines shown in FIG. 3 and illustrate an example placement of an item 111 within the package 100. The item 111 is illustrated with dashed lines to differentiate the item 111 from the package 100. Similar to FIGS. 7-9, only the cut-through portions of the package 100 are shown in FIGS. 10-12, with all other lines being omitted for clarity. As noted previously, the item 111 can be a 3.5 inch hard disk drive, which is generally rectangular in shape having approximate dimensions of 5.75 inches by 4 inches by 1 inch, although the package 100 can be configured for use with hard disk drives of other sizes, as well as many other types of items of all shapes and sizes.

FIG. 10 is a cross-sectional view of the package 100 and the item 111 taken along the line A-A shown in FIG. 3. As shown, the item 111 is positioned within the enclosed space 109 between the top portion 103 and the bottom portion 105 of the package 100. As illustrated, for some embodiments, the item 111 contacts the inner side of the top surface 115 at the depression 133 and also contacts the inner side of the bottom surface 119 at the indented wings 151 and indented portions 149. Thus, the item 111 is supported within the package 100 between the depression 133 and the indented wings 151 and indented portions 149. Further, the top surface 115 is spaced away from the item 111 at the wings 139 and walls 137 to create sway space 153 between the item 111 and the exterior surface of the package 100. Similarly, sway space 153 is created below the item where the boss 147 of the bottom surface 119 is spaced away from the item 111.

FIG. 11 is a cross-sectional view of the package 100 and the item 111 taken along the line B-B shown in FIG. 3. Again, the item 111 is positioned within the enclosed space 109 between the top portion 103 and the bottom portion 105 of the package 100. As illustrated, for some embodiments, the item 111 contacts the inner side of the top surface 115 at each of the valleys 135 and also contacts the inner side of the bottom surface 119 at the tops of the indentations 141. Thus, the item 111 is supported within the package 100 between the valleys 135 and the indentations 141. Further, the top surface 115 is spaced away from the item 111 at the protrusions 129 to create sway space 153 between the item 111 and the exterior surface of the package 100 at each of the protrusions 129. Similarly, sway space 153 is created below the item 111 where the raised portions 145 of the bottom surface 119 are spaced away from the item 111.

FIG. 12 is a cross-sectional view of the package 100 and the item 111 taken along the line C-C shown in FIG. 3. The item 111 is positioned within the enclosed space 109 between the top portion 103 and the bottom portion 105 of the package 100. As illustrated, for some embodiments, the item 111 contacts the inner side of the top surface 115 at the valleys 135 and the depression 133 and also contacts the inner side of the bottom surface 119 at the indented portions 149. Thus, the item 111 is supported within the package 100 between the valleys 135 and depression 133 and the indented portions 149. Further, the top surface 115 is spaced away from the item 111 at the raised walls 137 to create sway space 153 between the item 111 and the exterior surface of the package 100 at each of the raised walls 137. Similarly, sway space 153 is created below the item 111 where the raised portions 145 and the boss 147 of the bottom surface 119 are spaced away from the item 111.

Considering FIGS. 10-12 together, the topographies of the top and bottom surfaces 115, 119 are configured to contact the item 111 at several points in order to support the item 111 within the enclosed space 109 of the package, while at the same time, the topographies of the top and bottom surfaces 115, 119 are configured to be spaced away from the item 111 at several points in order to create sway space 153 around the item 111. In some embodiments, the sway space provides a protective cushion that protects the item 111 and absorbs shock.

The amount of cushion and shock absorption can be varied as desired by increasing or decreasing the size of the sway space 153. For example, more delicate items, such as HDDs, may require more cushion and shock absorption so as to be protected during distribution. Thus, the size of the sway space 153 may be increased to provide greater cushion and shock absorption. In some embodiments, the size of the sway space 153 may be increased by increasing the height or depth of the features that space the top and bottom surfaces 115, 119 away from the item. For example, the height of the protrusions 129 or frame 131 can be increased. Similarly, the depth of the indentations 141 or frame 143 can be increased. If less cushion or shock absorption is required, the height or depth of these features can be decreased. In some embodiments, the amount of cushion or shock absorption can be modified by varying the volume of the sway space 153. For example, if less cushion or shock absorption is needed, one or more of the protrusions 129 or indentations 141 can be omitted. Or, if more cushion or shock absorption is desired, additional protrusions 129 or indentations 141 can be added. Thus the package 100 can be scaled for use with a wide range of items 111 in a wide range of applications.

The shape of the protrusions 129 or indentations 141 can also provide cushioning and shock absorption. For example, the protrusions 129 or indentations 141 may act as springs or dampeners to absorb shock. In some embodiments, increasing the radius of the protrusions 129 or indentations 141 may increase their ability to absorb shock. In some embodiments, controlling the bearing area through the arch shape, the geometry may extend the duration of a shock pulse and reduce peak acceleration when the package 100 undergoes an impact. The series of arches illustrated as protrusions 129 can facilitate distributing the load substantially evenly. Other shapes may also absorb shock. For example, the depression 133, the boss 147, walls 137, indented portions 149, wings 139, and/or indented wings 151 may also absorb shock.

FIG. 13 is a perspective view and FIG. 14 is a side view of an embodiment of two nesting and shock absorbing packages 100 in a nested configuration. The packages 100 in FIGS. 13 and 14 may be similar to the package 100 described above with reference to FIGS. 1-12. As shown, an upper package 100 is positioned directly on top of a lower package 100. The protrusions 129 of the lower package 100 are received and nested into the indentations 141 of the upper package 100. The raised portions 145 of the upper package 100 are received and nested into the valleys 135 of the lower package 100. Additional features of the topographies of the bottom surface 119 of the upper package 100 and the top surface 115 of the lower package 100 may also be nested together as previously described even though they are not illustrated in the figures.

A particular advantage of the packages 100 is illustrated in FIG. 14. The sway space 153 of the upper package 100 (between the deepest point of the indentations 141 and the raised portions 145) and the sway space 153 of the lower package 100 (between the deepest point of the valleys 135 and the highest point of the protrusions 129) overlaps between the two packages 100 (e.g., along top and bottom surfaces 115, 119), for example, in plane 198. This minimizes the total amount of space required by the packages, improving the volumetric efficiency and shipping density of the stack of packages during distributing, while lowering damage/return rate of the products (e.g., item 111). Further, the topographies of the packages 100 provide cushioning and shock absorption for the items enclosed within. Additionally, the nesting of the packages 100 also stabilizes the stack by preventing the top package 100 from sliding off the bottom package 100. Accordingly, the packages 100 can provide individual items 111 protection while enabling the items 111 to be stacked in a stable arrangement during shipment and on distributors' shelves or counters.

In some embodiments, the flanges 117, 123 of the top portion 103 and the bottom portion 105, respectively, and/or the hinge 107 are configured to provide cushioning or shock absorption for the package 100. For example, the flanges 117, 123 and/or hinge 107 can be configured as shock absorbing ribs that extend outwardly from the package 100 to provide cushioning.

The shock absorbing and/or nesting features described throughout this application can be included on one or more of any of the sides of a package 100.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the disclosure should not be taken to imply that the terminology is being re-defined herein to be restricted to including any specific characteristics of the features or aspects of the technology with which that terminology is associated.

It will be appreciated by those skilled in the art that various modifications and changes can be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures can be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations can be expressly set forth herein for sake of clarity.

Directional terms used herein (e.g., top, bottom, side, up, down, inward, outward, etc.) are generally used with reference to the orientation shown in the figures and are not intended to be limiting. For example, the top surface described above can refer to a bottom surface or a side surface. Thus, features described on the top surface may be included on a bottom surface, a side surface, or any other surface.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods and materials of the present invention(s). This invention(s) is susceptible to modifications in the methods and materials, as well as alterations in the fabrication methods and equipment. Such modifications will become apparent to those skilled in the art from a consideration of this disclosure or practice of the invention(s) disclosed herein. Consequently, it is not intended that this invention(s) be limited to the specific embodiments disclosed herein, but that it cover all modifications and alternatives coming within the true scope and spirit of the invention(s) as embodied in the attached claims.

What is claimed is:

1. A package for enclosing at least one item, the package comprising:

a first portion including a first surface comprising a plurality of protrusions, each of the plurality of protrusions comprising an arched ridge having a first radius, the plurality of protrusions separated by one or more substantially flat valleys, each of the one or more substantially flat valleys formed between a pair of the plurality of protrusions, and a raised frame comprising raised walls surrounding a depression, wherein a height of the raised walls relative to the one or more substantially flat valleys is substantially the same as a height of the plurality of protrusions relative to the one or more substantially flat valleys, and a height of the depression is substantially the same as a height of the one or more substantially flat valleys;

a second portion including a second surface comprising a plurality of indentations, each of the plurality of indentations comprising an arched ditch having a second radius, wherein the second radius is substantially equal to the first radius, the plurality of indentations separated by one or more substantially flat raised portions, each of the one or more substantially flat raised portions formed between a pair of the plurality of indentations, and an indented frame comprising indented portions surrounding a boss, wherein a depth of the indented portions relative to the substantially flat raised portions is substantially the same as a depth of the plurality of indentations relative to the substantially flat raised portions, and a height of the boss is substantially the same as a height of the substantially flat raised portions; and a hinge connecting the first portion to the second portion, the hinge configured to allow the package to transition between an open position and a closed position; wherein, in the closed position, the first portion and the second portion define a space for enclosing at least one item.

2. The package of claim 1, wherein:

each arched ridge is convex; and each arched ditch is concave.

3. The package of claim 1, wherein:

the plurality of protrusions are positioned on the first surface and configured to nest with a plurality of indentations of a first other package stacked on a first side of the package; and the one or more substantially flat valleys are positioned on the first surface and configured to nest with one or more substantially flat raised portions of the first other package stacked on the first side of the package.

4. The package of claim 3, wherein:

the plurality of indentations are positioned on the second surface and configured to nest with a plurality of protrusions of a second other package stacked on a second side the package; and the one or more substantially flat raised portions are positioned on the second surface and configured to nest with one or more substantially flat valleys of the second other package stacked on a second side of the package.

5. The package of claim 1, wherein:

the plurality of protrusions are configured to space a first part of the first surface away from an item enclosed within the package to create sway space between the item and the first part of the first surface; and a second part of the first surface is configured to contact the item.

6. The package of claim 5, wherein:

the plurality of indentations are configured to space a first part of the second surface away from the item enclosed within the package to create sway space between the item and the first part of the second surface; and a second part of the second surface is configured to contact the item.

7. The package of claim 1, wherein:

the raised frame is configured to nest with an indented frame of another package stacked above the package; and the indented frame is configured to nest with a raised frame of another package stacked below the package.

8. The package of claim 1, wherein:

the depression is configured to nest with a boss of another package stacked above the package; and the boss is configured to nest with a depression of another package below the package.

9. A system of packages for items, the system comprising:

a first package having a first surface with a first topography comprising a plurality of protrusions, each of the plurality of protrusions comprising an arched ridge having a first radius, the plurality of protrusions separated by one or more substantially flat valleys, each of the one or more substantially flat valleys formed between a pair of the plurality of protrusions, and a raised frame comprising raised walls surrounding a depression, wherein a height of the raised walls relative to the one or more substantially flat valleys is substantially the same as a height of the plurality of protrusions relative to the one or more substantially flat valleys; and a second package having a second surface with a second topography comprising a plurality of indentations, each of the plurality of indentations comprising an arched ditch having a second radius, wherein the second radius corresponds to the first radius, the plurality of indentations separated by one or more substantially flat raised portions, each of the one or more substantially flat raised portions formed between a pair of the plurality of indentations, and an indented frame comprising indented portions surrounding a boss, wherein a depth of the indented portions relative to the substantially flat raised portions is substantially the same as a depth of the plurality of indentations relative to the substantially flat raised portions;

wherein:

the second topography corresponds to and is configured to nest with the first topography; and the first package is configured to stack with the second package such that the first surface contacts the second surface.

10. The system of claim 9, wherein the first topography and the second topography are configured to inhibit the first surface from sliding relative the second surface.

11. The system of claim 10, wherein:

the first package is configured to enclose a first item, a first portion of the first surface configured to contact the first item and a second portion of the first surface configured to be spaced away from the first item; and the second package is configured to enclose a second item, a first portion of the second surface configured to contact the second item and a second portion of the second surface configured to be spaced away from the second item.

12. The system of claim 11, wherein:

the second portion of the first surface is configured to create a first sway space between the first item and the first surface;

the second portion of the second surface is configured to create a second sway space between the second item and the second surface; and the first sway space and the second sway space are configured to overlap in a plane extending between the first item and the second item.

13. The system of claim 9, wherein the first topography and the second topography each comprise a wavy structure.

14. A method of stacking at least two packages, the method comprising:

providing a first package including a first surface comprising a first topography corn pri sing a plurality of protrusions, each of the plurality of protrusions comprising an arched ridge having a first radius, the plurality of protrusions separated by one or more substantially flat valleys, and a raised frame comprising raised walls surrounding a depression, wherein a height of the raised walls relative to the one or more substantially flat valleys is substantially the same as a height of the plurality of protrusions relative to the one or more substantially flat valleys;

providing a second package including a second surface comprising a second topography configured to nest with the first topography, the second topography comprising a plurality of indentations, each of the plurality of indentations comprising an arched ditch having a second radius, wherein the second radius corresponds to the first radius, the plurality of indentations separated by one or more substantially fla raised portions, and an indented frame comprising indented portions surrounding a boss, wherein a depth of the indented portions relative to the substantially flat raised portions is substantially the same as a depth of the plurality of indentations relative to the substantially flat raised portions; and stacking the first package and the second package such that the first surface contacts and nests with the second surface.

15. The method of claim 14, wherein stacking the first package and the second package comprises receiving a protrusion of the first topography within an indentation of the second topography.

16. The method of claim 14, further comprising enclosing a first item in the first package.

17. A package for enclosing at least one item, the package comprising:

a first portion including a first surface comprising a plurality of protrusions, each of the plurality of protrusions comprising an arched ridge having a first radius, the plurality of protrusions separated by one or more substantially flat valleys; each of the one or more substantially flat valleys formed between a pair of the plurality of protrusions, and a raised frame comprising raised walls surrounding a depression, wherein a height of the raised walls relative to the one or more substantially flat valleys is substantially the same as a height of the plurality of protrusions relative to the one or more substantially flat valleys, and a height of the depression is substantially the same as a height of the one or more substantially flat valleys;

a second portion including a second surface comprising a plurality of indentations, each of the plurality of indentations comprising an arched ditch having a second radius, wherein the second radius is substantially equal to the first radius, the plurality of indentations separated by one or more substantially flat raised portions, each of the one or more substantially flat raised portions formed between a pair of the plurality of indentations, and an indented frame comprising indented portions surrounding a boss, wherein a depth of the indented portions relative to the substantially flat raised portions is substantially the same as a depth of the plurality of indentations relative to the substantially flat raised portions; and a height of the boss is substantially the same as a height of the substantially flat raised portions; and means for allowing the package to transition between an open position and a closed position, wherein, in the closed position, the first portion and the second portion define a space for enclosing at least one item.

18. The package of claim 1, wherein:

a first group of the plurality of protrusions are positioned along a first side of the package;

a second group of the plurality of protrusions are positioned along a second side of the package, the second side opposite the first side; and the raised frame is positioned between the first group and the second group along the first surface of the first portion.

19. The package of claim 18, wherein the raised frame further comprises:

a first raised wing extending between the first group and the second group to a third side of the package, the third side extending substantially perpendicular to the first and second sides, and a second raised wing extending between the first group and the second group to a fourth side of the package, the fourth side opposite the third side.

20. The package of claim 19, wherein a height of the first raised wing and the second raised wing is substantially equal to the height of the raised walls of the indented frame.

21. The package of claim 19, wherein:

the plurality of protrusions comprises at least a first protrusion positioned adjacent to the third side and a second protrusion positioned adjacent to the fourth side and one or more other protrusions of the plurality of protrusions positioned between the first protrusion and the second protrusion; and a length of the first and second protrusions, measured in a direction between the first and second sides is longer than a length of the one or more other protrusions positioned between the first protrusion and the second protrusion.

* * * * *